US008974079B2

(12) United States Patent
Foringer et al.

(10) Patent No.: US 8,974,079 B2
(45) Date of Patent: Mar. 10, 2015

(54) LIGHTING SYSTEM WITH INTEGRATED EL PANEL

(75) Inventors: Jason Foringer, Houston, TX (US); George Kasee, Austin, TX (US); Jerrold W. Mayfield, Georgetown, TX (US)

(73) Assignee: Limelite Technologies, Inc., Austin, TX (US)

( * ) Notice: Subject to any disclaimer, the term of this patent is extended or adjusted under 35 U.S.C. 154(b) by 371 days.

(21) Appl. No.: 13/480,309

(22) Filed: May 24, 2012

(65) Prior Publication Data

US 2013/0088149 A1 Apr. 11, 2013

Related U.S. Application Data

(63) Continuation-in-part of application No. 13/299,588, filed on Nov. 18, 2011, now Pat. No. 8,786,189.

(60) Provisional application No. 61/489,527, filed on May 24, 2011.

(51) Int. Cl.

| | |
|---|---|
| ***F21S 4/00*** | (2006.01) |
| ***F21V 17/00*** | (2006.01) |
| ***H05B 37/02*** | (2006.01) |
| ***F21S 8/04*** | (2006.01) |
| ***G08B 7/06*** | (2006.01) |
| ***G08B 19/00*** | (2006.01) |
| ***H05B 35/00*** | (2006.01) |

(52) U.S. Cl.

CPC . *H05B 37/02* (2013.01); *F21S 8/04* (2013.01); *G08B 7/062* (2013.01); *G08B 19/005* (2013.01); *H05B 37/0227* (2013.01); *H05B 37/0272* (2013.01); *H05B 35/00* (2013.01)

USPC ..... 362/249.01; 362/366

(58) Field of Classification Search

USPC ..... 362/600, 601, 608, 609, 612, 613, 362/249.01, 249.02, 362, 363, 365, 366

See application file for complete search history.

(56) References Cited

U.S. PATENT DOCUMENTS

| | | | |
|---|---|---|---|
| 3,078,389 | A | 2/1963 | Corry |
| 3,344,269 | A | 9/1967 | Brown |
| 4,105,927 | A | 8/1978 | Wilje |
| 4,531,114 | A | 7/1985 | Topol et al. |

(Continued)

OTHER PUBLICATIONS

International Search Report received in corresponding PCT application No. PCT/US2012/039454, dated Oct. 1, 2012.

(Continued)

*Primary Examiner* — Minh D A

(74) *Attorney, Agent, or Firm* — Wong, Cabello, Lutsch, Rutherford & Brucculeri, LLP

(57) ABSTRACT

A lighting system has a receptacle for a light source disposed on a light fixture. The receptacle couples to a first power source, such as standard alternating current available in a building. An electroluminescent (EL) panel is disposed adjacent the light fixture and couples either to the same first power source or to a second power source, such as a direct current emergency power source of a battery or a building. For the EL panel also coupled to the first power source, circuitry illuminates the electroluminescent panel with power from the first power source when the receptacle for the light source is disconnected from the first power source. For the EL panel connected to the second power source, the circuitry illuminates the EL panel with power from the second power source during a failure of the first power source.

25 Claims, 11 Drawing Sheets

(56) References Cited

U.S. PATENT DOCUMENTS

| | | | |
|---|---|---|---|
| 4,763,115 | A | 8/1988 | Cota |
| 4,796,018 | A | 1/1989 | Nakanishi et al. |
| 4,816,809 | A | 3/1989 | Kim |
| D352,564 | S | 11/1994 | Marischen |
| 5,493,272 | A | 2/1996 | Beghelli |
| 5,572,183 | A | 11/1996 | Sweeney |
| 5,662,408 | A | 9/1997 | Marischen |
| 5,816,682 | A | 10/1998 | Marischen |
| D404,508 | S | 1/1999 | Marischen |
| 5,886,620 | A | 3/1999 | Stewart et al. |
| 5,897,194 | A | 4/1999 | Ham |
| 6,249,221 | B1 | 6/2001 | Reed |
| 6,304,039 | B1 | 10/2001 | Appelberg et al. |
| 6,384,724 | B1 | 5/2002 | Landais |
| 6,518,878 | B1 | 2/2003 | Skoff |
| 6,606,808 | B2 | 8/2003 | Katz |
| 6,778,071 | B2 | 8/2004 | Megerle |
| 6,859,145 | B2 | 2/2005 | Wilker et al. |
| 6,873,256 | B2 | 3/2005 | Lemelson et al. |
| 7,026,768 | B1 | 4/2006 | Ruiz |
| 7,154,379 | B2 | 12/2006 | Reed |
| 7,158,040 | B2 | 1/2007 | Morris |
| 7,182,174 | B2 | 2/2007 | Parrini et al. |
| 7,191,510 | B1 | 3/2007 | Sanderson et al. |
| 7,259,670 | B2 | 8/2007 | Cunningham et al. |
| 7,385,517 | B2 | 6/2008 | Andres et al. |
| 7,528,700 | B2 | 5/2009 | Picard et al. |
| 2001/0013185 | A1 | 8/2001 | Chen |
| 2001/0040798 | A1 | 11/2001 | Appelberg et al. |
| 2002/0040798 | A1 | 4/2002 | Intonen et al. |
| 2003/0179577 | A1 | 9/2003 | Marsh |
| 2003/0189823 | A1 | 10/2003 | George et al. |
| 2005/0052339 | A1 | 3/2005 | Sprague |
| 2006/0103638 | A1 | 5/2006 | Podd |
| 2007/0096663 | A1 | 5/2007 | Wong et al. |
| 2010/0019689 | A1 * | 1/2010 | Shan ..... 315/294 |
| 2010/0045155 | A1 | 2/2010 | Padilla |
| 2010/0263184 | A1 | 10/2010 | Ray et al. |
| 2012/0126700 | A1 | 5/2012 | Mayfield et al. |

OTHER PUBLICATIONS

"LTC3535 Dual Channel 550mA 1MHz Synchronous Step-Up DC/DC Converter," (c) Linear Technology Corporation 2009, www.linear.com, LT 0910 REV A, 16 pages.

"LT3580 Boost/Inverting DC/DC Converter with 2A Switch, Soft-Start, and Synchronization," (c) Linear Technology Corporation 2007, www.linear.com, LT0809 REV E, 28 pages.

Microchip, PIC16F684 Data Sheet, "14-Pin, Flash-Based 8-Bit CMOS Microcontrollers with nano Watt Technology," (C) 2007 Microchip Technology, Inc., DS41202F, 192 pages.

"Dual In-Series Small-Signal High Voltage Switching Diode," Vishay Semiconductors, GSD2004S-V, Document No. 85728, www.vishay..com, Rev. 1.4, Jan. 3, 2006, 5 pages.

Omron, "PCB Relay G5V-2: Miniature Relay for Signal Circuits," Cat. No. K046-E1-03, 4 pages.

* cited by examiner

LIGHTING SYSTEM WITH INTEGRATED EL PANEL

CROSS-REFERENCE TO RELATED APPLICATIONS

This application is a continuation-in-part of U.S. application Ser. No. 13/299,588, filed 18 Nov. 2011, and this application claims the benefit of U.S. Provisional App. No. 61/489,527, filed 24 May 2011, both of which are incorporated herein by reference and to which priority is claimed.

BACKGROUND

Commercial and residential buildings use lighting throughout rooms, hallways, corridors, and other areas to illuminate these locations. During power failures or emergencies, certain lighting can be maintained in the building although the majority of fixtures are not illuminated. This emergency lighting helps illuminate exits and escape routes. Typically, power to illuminate the emergency lighting is provided by a backup power source, such as a generator, battery, or other power line. Unfortunately, not all areas of a building can be illuminated by the emergency lighting system because this would require extensive implementation of the needed components.

When commercial and residential buildings are only partially occupied or empty, such as at night, the need for illuminating certain areas greatly diminishes. For this reason, sometimes only portions of the building's lighting is illuminated to conserve power, while still maintaining at least some illumination for safety and security reasons. Being able to partially illuminate areas of a building to conserve power and to prolong the life of fluorescent or other lights by alleviating nighttime workload can be a great benefit.

What is needed is a way to inexpensively provide emergency or ancillary lighting for commercial and residential applications that can be incorporated into the existing fixtures of such buildings.

SUMMARY

To that end, a lighting system as disclosed herein is intended to provide emergency or ancillary lighting for commercial and residential applications. The lighting system can be incorporated into existing fixtures or features of such buildings. The lighting system has a receptacle for a light source disposed on a light fixture. Various types of light sources and light fixtures can be used. The receptacle couples to a first power source, such as standard alternating current available in a building. An electroluminescent (EL) panel is disposed adjacent the light fixture and couples either to the same first power source, to a second power source, such as a direct current emergency power source of a battery or a building, or to both the first and second power sources. This EL panel can be disposed on a shade or a reflector disposed on the light fixture, or the EL panel can be disposed on a ceiling tile or some other location in the building. Moreover, the EL panel can be used in an exit sign of an emergency monitoring system.

For the EL panel coupled to the first power source, circuitry illuminates the electroluminescent panel with power from the first power source when the receptacle for the light source is disconnected from the first power source. For the EL panel connected to the second power source, the circuitry illuminates the EL panel with power from the second power source during a failure of the first power source.

DETAILED DESCRIPTION

Figure 1:
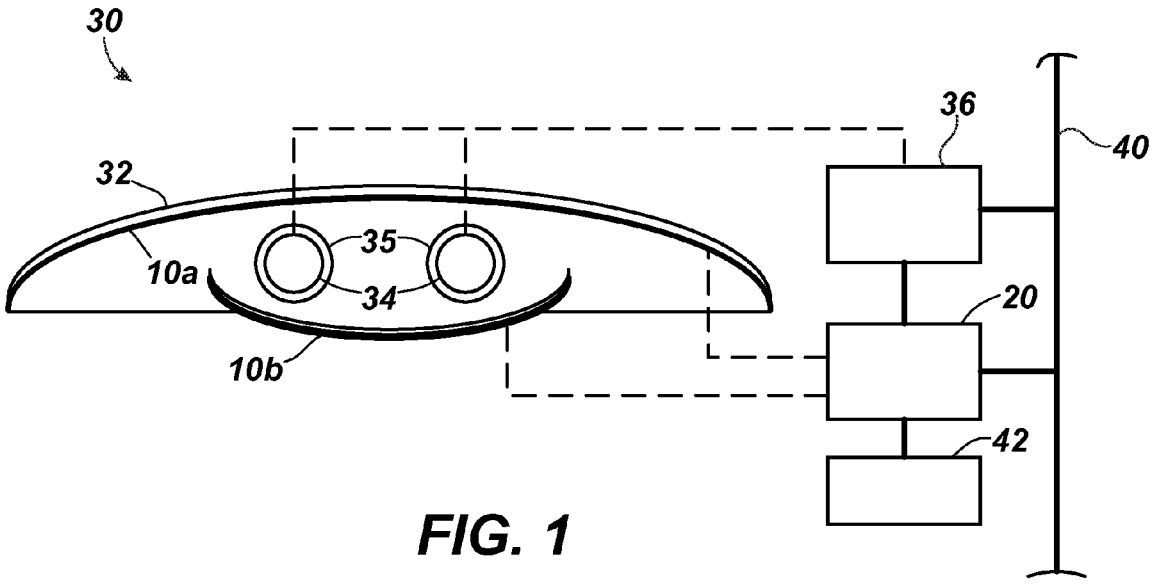
FIG. 1 shows a fluorescent light fixture having electroluminescent (EL) panels according to the present disclosure.

FIG. 1 shows a fluorescent light fixture 30 having one or more electroluminescent (EL) panels 10*a-b* according to the present disclosure. This fluorescent light fixture 30 can be similar to those used in commercial settings. Accordingly, the fixture 30 has fluorescent light tubes 34 installed in receptacles or sockets 35 for the tubes 34, and the receptacle 35 couple to conventional circuitry 36 and a power supply 40 for illuminating the tubes 34. Although fluorescent tubes 34 are shown, any of a number of light sources can be used, such as incandescent lights, compact fluorescents (CFL), light emitting diodes (LED), halogen light, etc. As is typical, the power supply 40 can be standard NC power provided in a building or the like, and the power circuitry 36 can use a ballast to regulate current, such as an inductor for A/C power.

Here, an EL panel 10*a* can be attached to the inner surface of the fixture's reflective surface 32. The EL panel 10*a* can be attached to the entire reflector 32 or just a portion thereof, and adhesive, fasteners, or the like can be used to attach the panel 10*a* to the reflector 32. Any adhesive used is preferably heat activated. The other EL panel 10*b* can be attached to an outer surface of the fixture 30 if present. In general, the fixture 30 can have one or both of the panels 10*a-b* in these positions.

The EL panels 10 couple to EL power circuitry 20, which provides the necessary supply of alternating current to illuminate the EL panels 10 as discussed herein. The circuitry 20 can be powered and controlled from the fluorescent circuitry 36. Alternatively, the circuitry 20 can be directly connected to the building's power supply 40. Still further, the circuitry 20 can be connected to an auxiliary power supply 42, such as an emergency power supply for the building.

When the fixture 30 is on, the fluorescent circuitry 36 draws power from the power supply 40 and illuminates the fluorescent tubes 34. While these tubes 34 are "on," the EL panels 10*a-b* may or may not be illuminated, although they are preferably not illuminated. Instead, when the tubes 34 are "off," the EL panels 10*a-b* are preferably illuminated to provide ancillary or backup lighting, either at night, during an emergency, or for some other reason. Thus, turning "on" and "off" the EL panels 10*a-b* can coincide with the reverse turning "off" and "on" of the light fixture 30 or can coincide with a switch to change from the convention power supply 40 to the emergency power supply 42.

Figure 2:
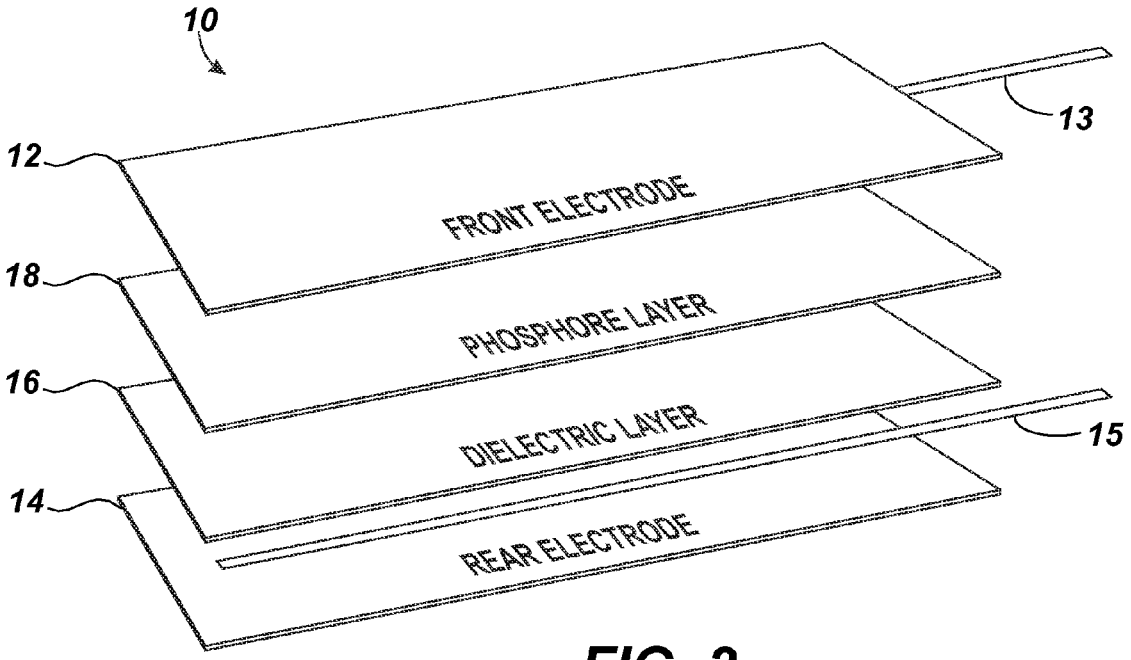
FIG. 2 shows components of electroluminescent panel in an exploded view.

Details of an electroluminescent (EL) panel 10 are shown in FIG. 2, which presents the components of an EL panel 10 in an exploded view. As is known, electroluminescence directly converts electric energy to light using a solid phosphor subjected to an alternating electric field. The EL panel 10 functions when phosphor particles are excited by an electrical field generated by applying an alternating current to front and back electrodes that sandwich a phosphor layer. The front and rear electrodes simply pass the electrical current and do not convert this into any other form of energy, such as heat or ultraviolet radiation.

The panel 10 has a front electrode layer 12, a rear electrode layer 14, a dielectric insulating layer 16, and a microencapsulated solid phosphor layer 18. The EL panel 10 illuminates when the microencapsulated solid phosphors in the phosphor layer 18 are excited by an alternating electrical current (AC). In particular, alternating current is applied to the front and rear electrode layers 12/14 by leads 13/15, and an electromagnetic (EM) field is created that excites the phosphor layer 18 to produce luminous energy.

The EL panel 10 operate with relatively little current, which makes it well suited for light sources that operate continuously or for extended periods of time. The EL panel 10 essentially operates as a capacitor with its dielectric layer 16 and phosphor layer 18 disposed between the two conductive electrodes 12 and 14. The front layer 12 is typically transparent.

Details related to electroluminescent elements are provided in U.S. Pat. Nos. 5,662,408; 5,816,682; and 7,191,510, which are incorporated herein by reference in their entireties. For example, the transparent front electrode 12 can be made out of indium tin oxide. The phosphor layer 18 has encapsulated phosphor screen-printed over the front electrode 12. The dielectric layer 16 can contain a solvent, a binder, and barium titanate particles that are screen-printed over the phosphor layer 18. The rear electrode 14 typically has a solvent, a binder, and conductive particles such as silver or carbon that are screen-printed over the dielectric layer 16.

Figures 3A, 3B:
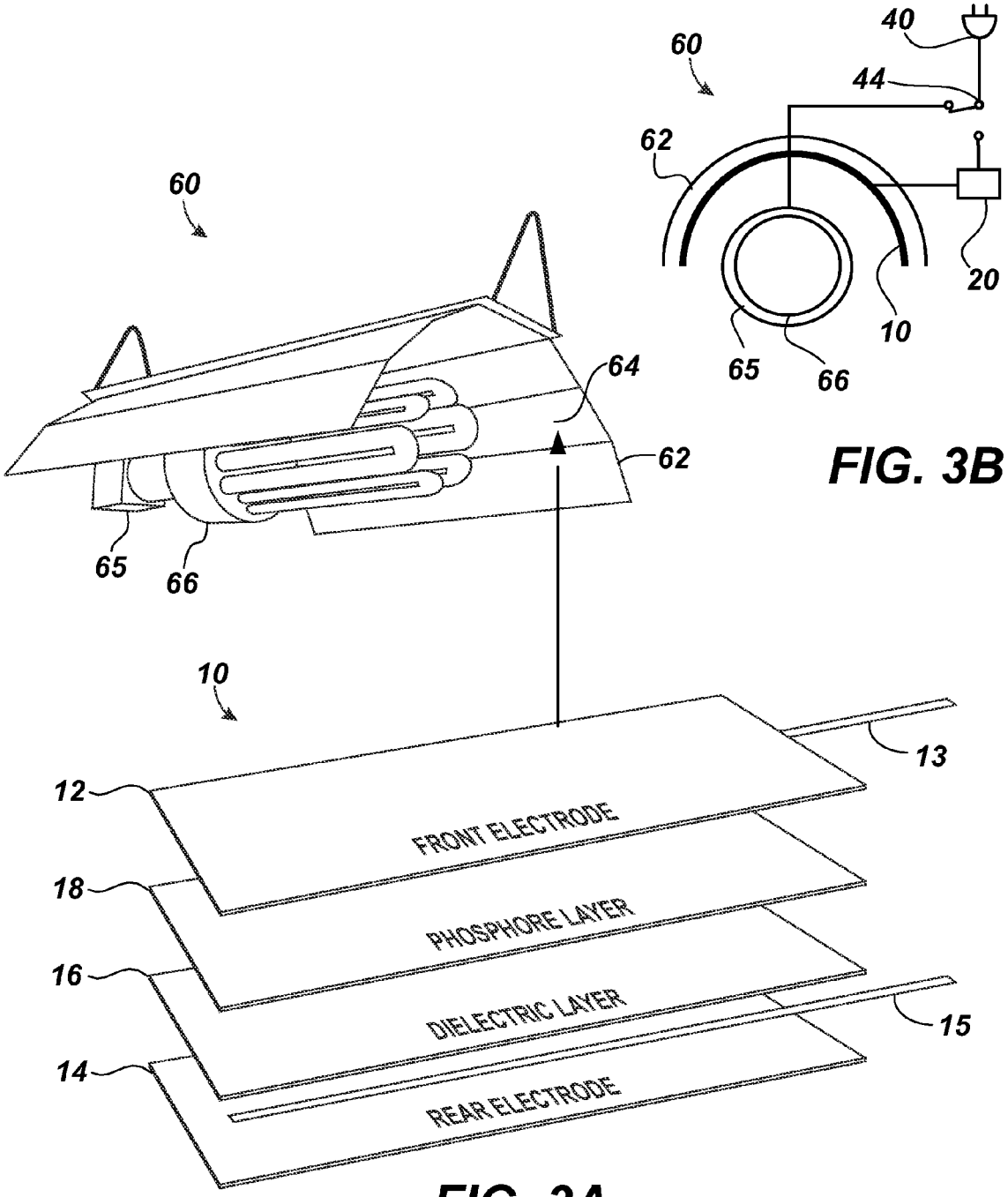
FIGS. 3A-3B shows another fluorescent light fixture having an EL panel according to the present disclosure.

FIGS. 3A-3B show another fluorescent light fixture 60 having an EL panel 10. Here, the fixture 60 is a compact fluorescent lighting fixture having a reflector 62 with a reflecting surface 64 and having a compact fluorescent light 66 installed in a receptacle or socket 65. The EL panel 10 affixes to the surface 64 of the reflector 62 and connects to the EL power circuitry 20 as discussed herein.

As shown in FIG. 3B, the fluorescent lamp 66 may normally couple to the building's power supply 40 when "on." A controller or switch 44 that turns "off" the power to the lamp 66 instead connects the EL circuitry 20 to the power supply 40 so the EL panel 10 can be illuminated. Other arrangements to supply power to the lamp 66 and circuitry 20 can be used, as discussed herein.

Figures 4A, 4B:
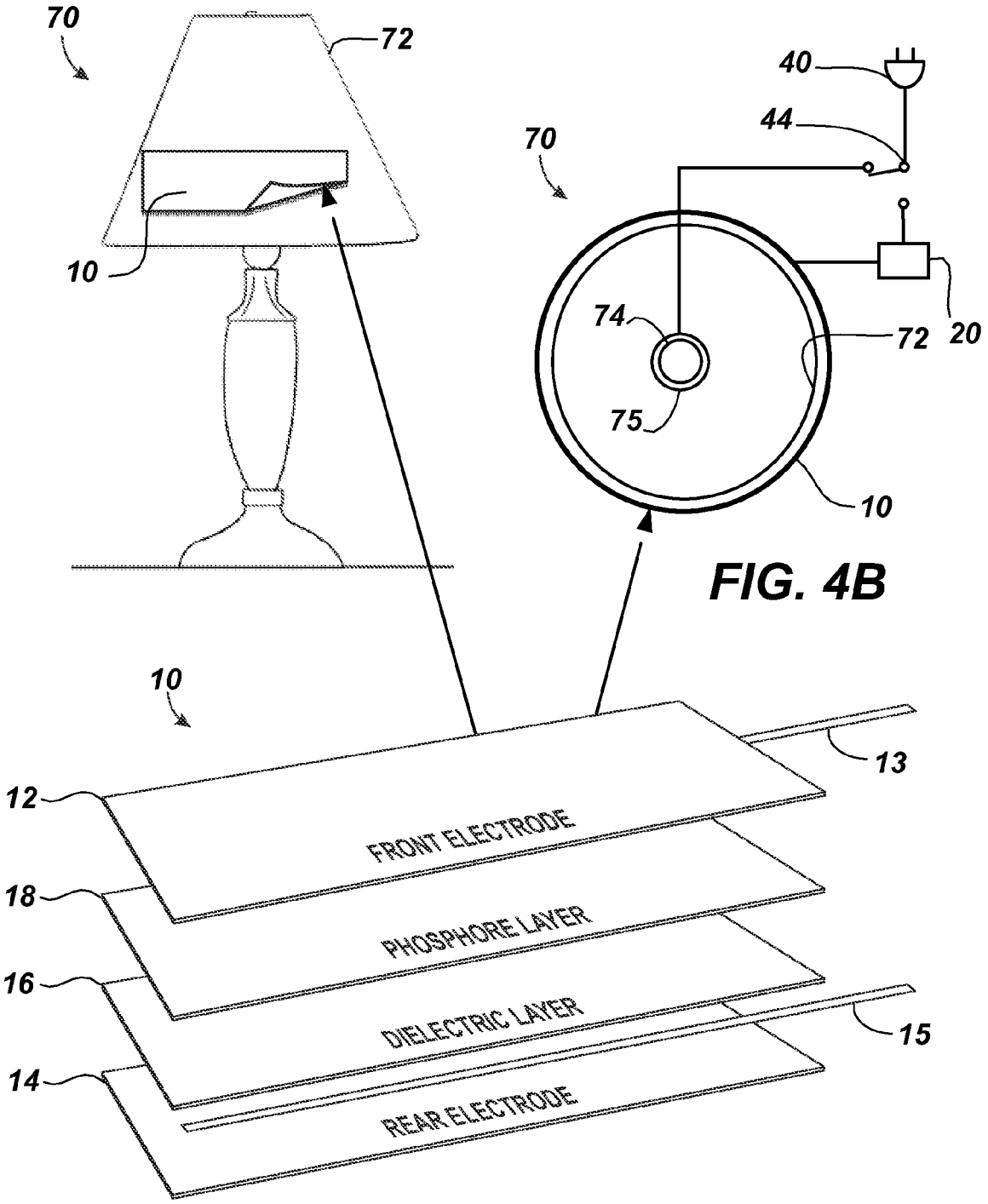
FIGS. 4A-4B shows an incandescent light fixture having an EL panel according to the present disclosure.

FIGS. 4A-4B shows an incandescent light fixture 70 having an EL panel 10 attached outside a lampshade 72 of the fixture 70, which can be a desk, table, or floor lamp. As shown in FIG. 4B, the incandescent light 74 installs in a receptacle or socket 75 and may normally couple to the building's power supply 40 when turned "on." A controller or switch 44 that turns "off" the power to the light 74 instead connects the EL circuitry 20 to the power supply 40 so the EL panel 10 can be illuminated. Other arrangements to supply power to the lamp and circuitry 20 can be used, as discussed herein.

Figure 5:
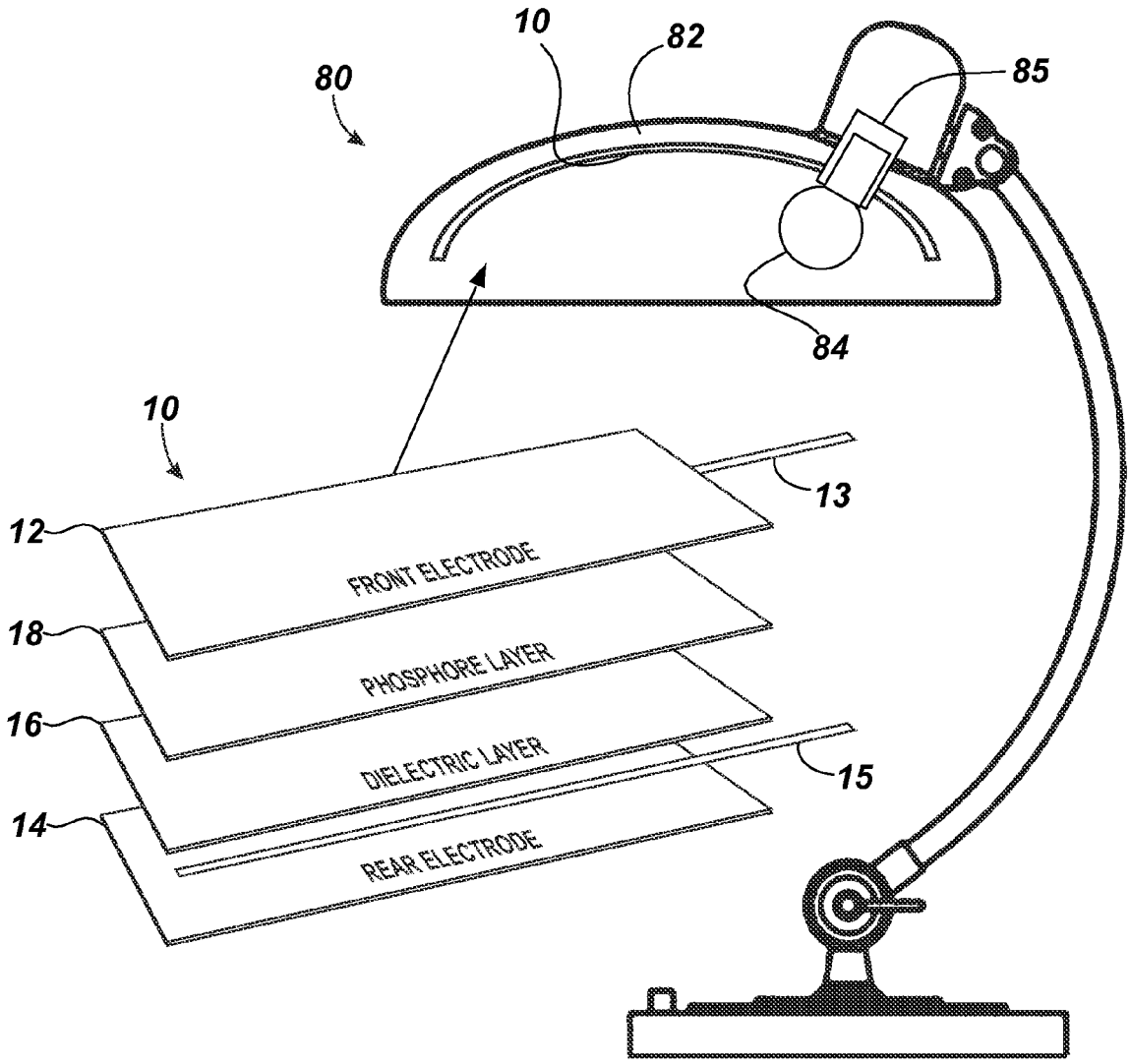
FIG. 5 shows another incandescent light fixture having an EL panel according to the present disclosure.

As shown in FIG. 4A, the panel 10 can affix outside the lampshade 72, either partially or entirely thereon. Alternatively, it can be affixed inside the lampshade 72. For example, FIG. 5 shows another incandescent light fixture 80 having an EL panel 10 attached inside the lampshade or reflector 82 of a desk, table, or floor lamp having an incandescent light 84 installed in a receptacle or socket 85.

Figure 6:
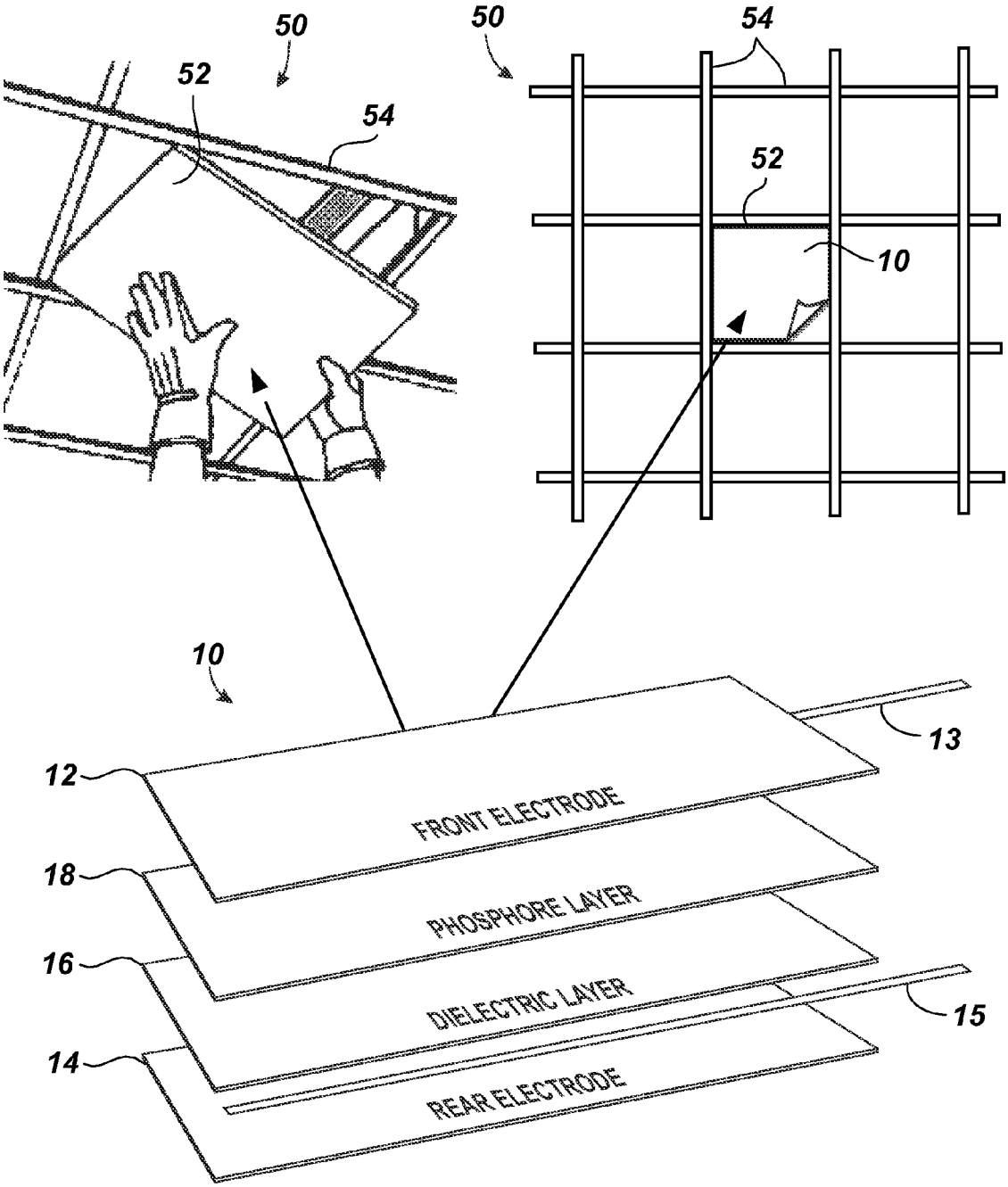
FIG. 6 shows an acoustic ceiling tile having an EL panel according to the present disclosure.

FIG. 6 shows a suspended or dropped ceiling system 50 having acoustic ceiling tiles 52, cross-members or runners 54, and EL panels 10 according to the present disclosure. The ceiling tiles 52 can be those typically used in commercial buildings for a dropped ceiling. These tiles 52 are typically made of fire resistant and noise dampening material, and they fit into place in the supporting frame of runners 54 hung from the building's ceiling.

One or more EL panels 10 attach to the surface of one or more of these ceiling tiles 52 and connect to a power supply (not shown) as noted herein. These EL panels 10 on the tiles 52 can be illuminated when conventional lighting in a building is turned off, during an emergency, or for some other purpose. For example, a group of the panels 10 may be attached to ceiling tiles 52 near an exit. Lined sets of the EL panels 10 on tiles 52 can be used to illuminate and indicate an escape route along the ceiling. These and other possibilities can be used.

Figure 7:
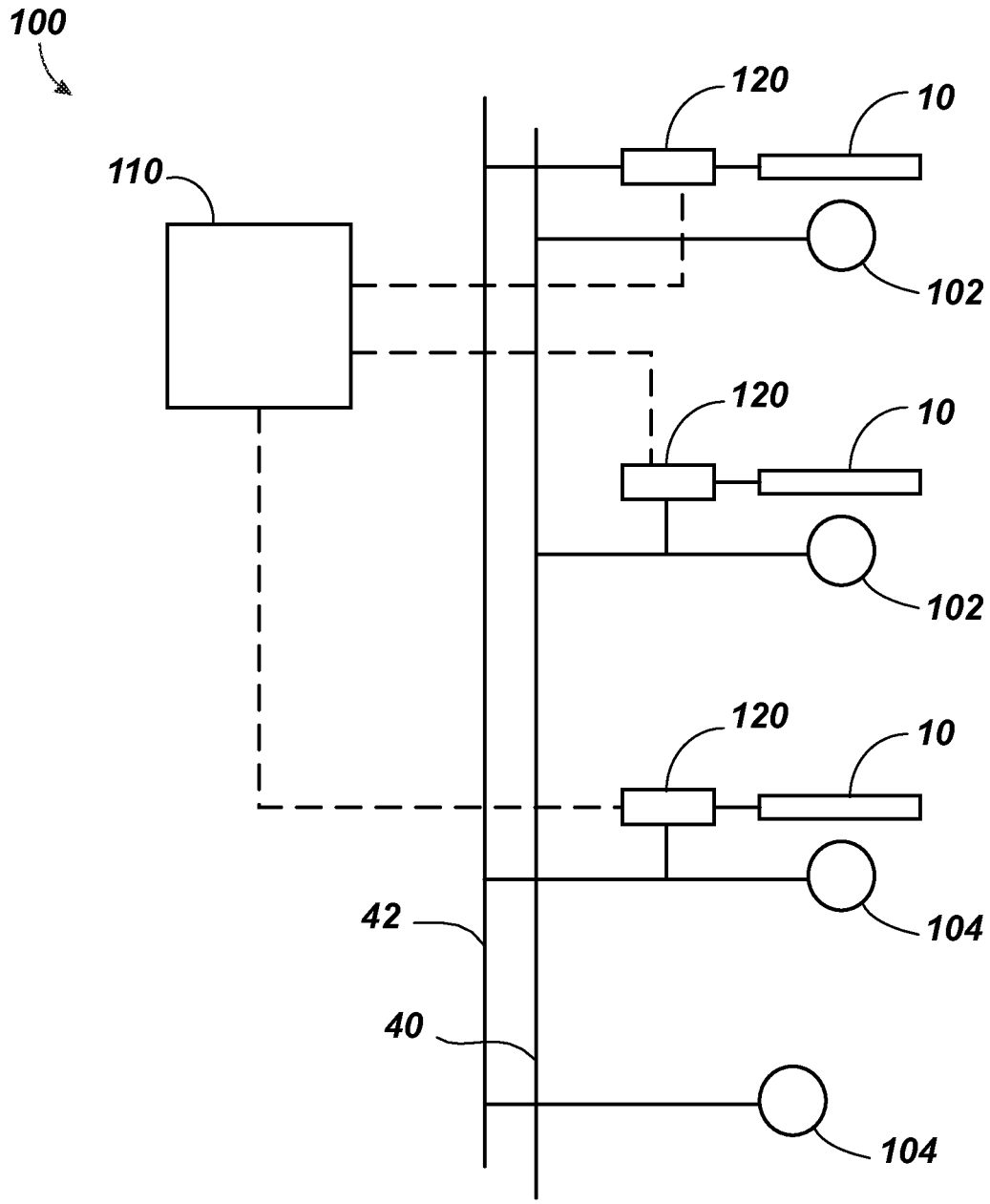
FIG. 7 schematically illustrates a lighting system according to the present disclosure.

FIG. 7 schematically illustrates a commercial or residential lighting system 100 according to the present disclosure. Several conventional lighting fixtures 102, such as discussed previously, couple to the standard power supply 40 for the building. In addition, several emergency lighting fixtures 104 can couple to an emergency power supply 42 for the building. The emergency power supply 42 can be provided by battery, generator, or the like. The emergency light fixtures 104 can be remotely installed fixtures coupled to the power supply 42 by building wiring. In other cases, the emergency light fixtures 104 can have its own local power supply 42 provided by a battery backup.

Either associated with or separate from these light fixtures 102/104, the system 100 also has several EL panels 10 with controllers 120 for providing supplemental light during an emergency or other purpose disclosed herein. The number and placement of the various EL panels 10 in a building depend on how large the rooms are, how many light fixtures are present, where illumination is desired, and other considerations.

The controllers 120 can generally include the power circuitry discussed previously for providing the necessary power to illuminate the EL panels 10. Preferably and as discussed in more detail below, these controllers 120 may include some additional circuitry to control the illumination of the EL panels 10. As shown in FIG. 7, the controllers 120 can be coupled to the conventional power supply 40, to the emergency power supply 42, or to both.

The system 100 also has a central monitoring workstation 110 that couples to the building's existing wiring and power supplies. This central workstation 110 can include one or more computers and can have its own backup power supply (not shown). The workstation 110 can include conventional features for monitoring the security and safety of a building. For example, the workstation 110 can monitor fire alarms and security alarms of the building.

To communicate with the various controllers 120 of the EL panels 10, the workstation 104 can couple to the controllers 110 via the existing building wiring 102, dedicated wiring, or wireless communication system. For wireless communication, the controllers 120 of the EL panels 10 have wireless communication devices, such as wireless transceivers known and used in the art.

In some instances when an associated fixture 102 is turned "off," then the EL panel 10 can be illuminated using the main power supply 40. In other instances, regular power may go out due to an emergency or power failure. In this case, the EL panel 10 can use emergency power 42 to switch "on" either from the buildings emergency wiring or a backup battery. The controller 120 can also increase the brightness of the EL panel 10 when using the backup power from the emergency wiring or battery. For example, the regular power supply 40 can be 120 Volts, 60 Hz. The brightness of the EL panel 10 during regular AC power operation can be from about 3.5 to 5 fL (foot lamberts). When switched to backup power supply 42, the brightness of the panel 10 can be increased to 7 fL (foot lamberts) during emergency DC power operation.

The controllers 120 control the brilliance of the EL panels 10 as discussed below. In one technique, the controller 120 can control the voltage applied to the EL panel 10. By increasing the voltage, the controller 120 can increase the element's brilliance, although this is not a preferred way to increase the brilliance.

In another technique, the controller 120 modifies the waveform used to operate the EL panel 10. In general, a sharper rise time of the waveform increase the brightness of the EL panel 10. The controller 120 can modify the sine wave with faster rising edges to change the RMS voltage used for the EL panel 10. This increases the brilliance of the EL panel 10 with all other parameters held constant. Yet, this technique may shorten the life of the EL panel 10 so that it may not be preferred in some implementations.

In yet another technique, the controller 120 can control the brilliance of the EL panel 10 by increasing the frequency of the sine wave used. To do this, the controller 120 is programmed with power control algorithms so the controller 110 can control the waveform and frequency of the sine wave used to operate the EL panel 10. Using PWM (pulse width modulation) signaling and a low pass filter, the controller 110 creates a waveform at a desired frequency. In general, the higher the frequency produced by the controller 120, the brighter the EL panel 10 will illuminate. Preferably, the desired frequency for operating the EL panel 10 is in the range of 50 to 80-Hz.

Similar to the monitoring system disclosed in incorporated U.S. application Ser. No. 13/299,588, the monitoring system 100 of the present disclosure can have integrated exit signs (not shown). In preferred implementations, the exit signs have electroluminescent elements, such as the disclosed electroluminescent panels 10 or light emitting capacitors. The exit signs connect to the internal wiring of a building. Local power sources for the each of the exit signs can provide emergency power if the building power is lost, or the signs can uses ancillary back up power lines 42 of the building.

Controllers on the exit signs, such as controllers 120 for the EL panels 10, communicate with the central monitoring workstation 110 using the existing wiring and/or wireless communication. The controllers 120 have one or more automated features for monitoring operation of the exit signs and the surrounding environment. These automated components include one or more of intensity sensor, ambient light sensor, temperature sensor, memory unit, smoke detector, camera, speaker, microphone, motion detector, RFID detector, and the like. Because the exit signs are widely distributed throughout the building, operators, firemen, and the like can get detailed information of the building environment, security, fire, smoke, temperature, etc. The exit signs can store this information locally in memory and can communicate useful information using WI-FI, WLAN, WWAN, LAN, or other form of communication to the central workstation 110. FIGS. 8-14 show some of the control circuitry for the controller 120 of the disclosed EL panel 10, and details of these portions of the control circuitry are discussed below. The control circuitry can also be found in incorporated U.S. application Ser. No. 13/299,588, filed 18 Nov. 2011, claiming the benefit of U.S. Prov. Appl. Ser. No. 61/415,143 filed 18 Nov. 2010 and entitled "Integrated Exits Signs and Monitoring System," which are incorporated herein by reference in their entireties.

Figure 8:
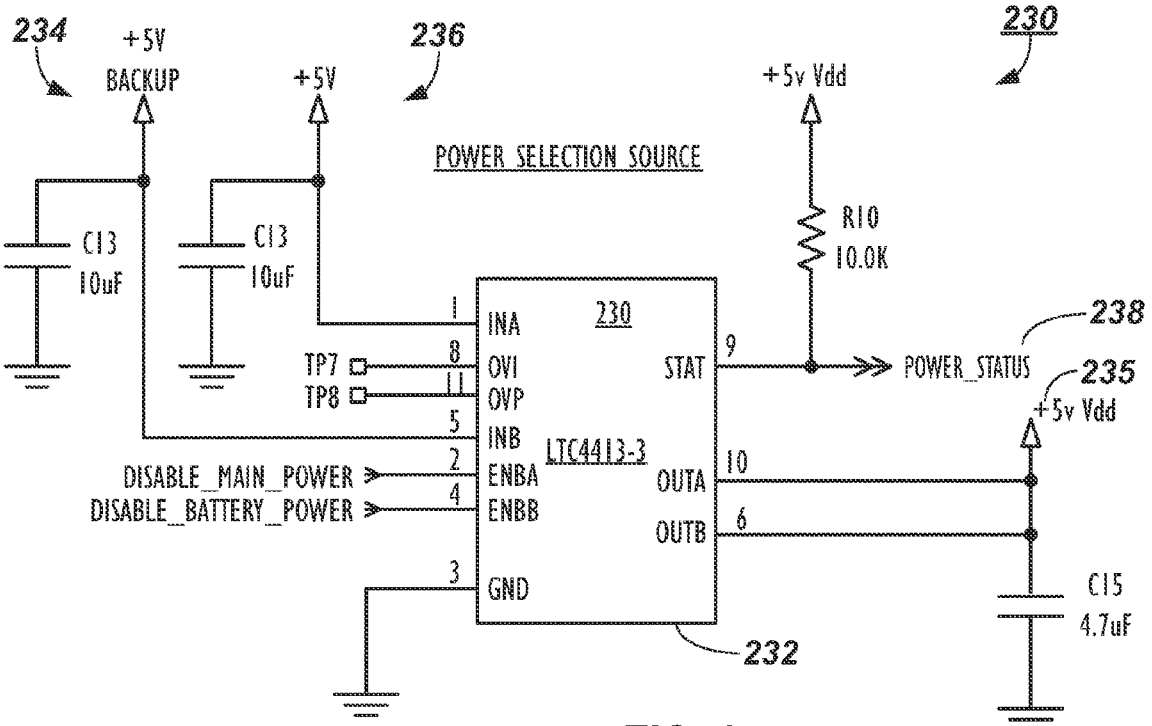
FIGS. 8-14 show control circuitry for the disclosed EL panel.
Figure 10:
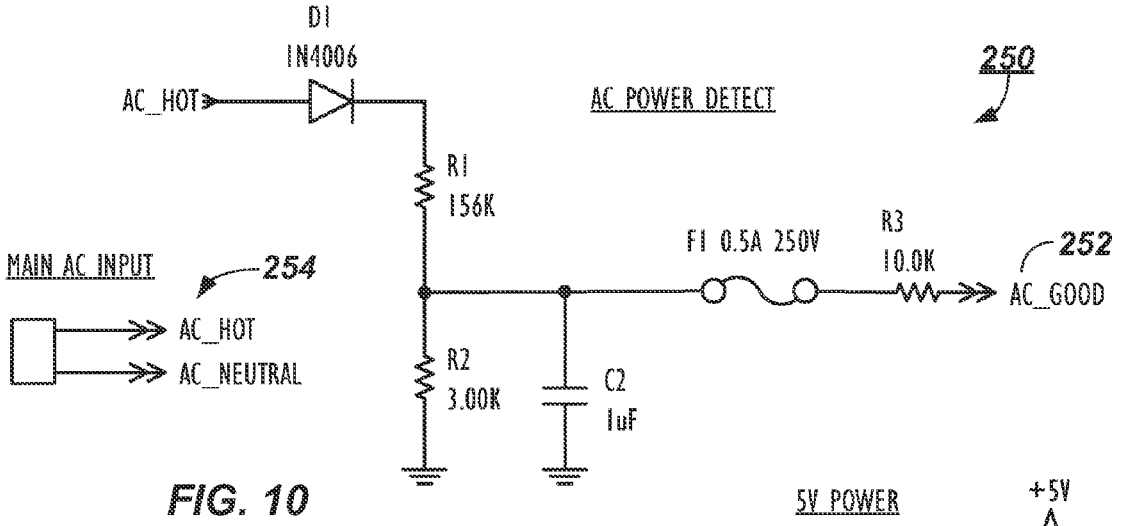

FIG. 8 shows a power selection circuit 230. The circuit 230 uses an O-ring diode 232, such as the LTC4413-3 available from Linear Technology. This circuit 230 is used to select a backup power 234 from a battery or to select a source power 236 from a main AC input (FIG. 10). Power status 238 is provided by the circuit 230 to a microcontroller discussed below in FIG. 12. Additionally, output power 235 is provided by the circuit 230 for the control circuitry.

Figure 9:
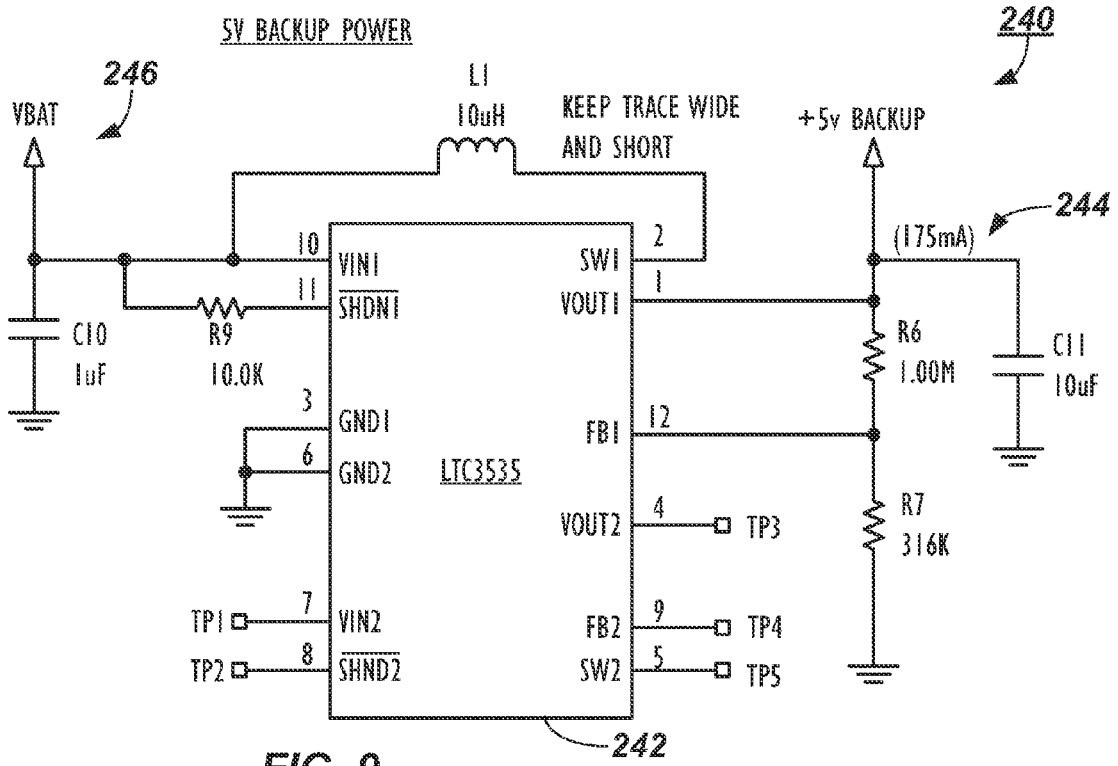

FIG. 9 shows a 5V backup power circuit 240 having a dual channel, synchronized, fixed frequency step-up DC/DC converter 242. The circuit 240 can use a step-up DC/DC converter 242, such as the LTC3535 available from Linear Technology. Battery power 246 is received and backup power 244 is provided for the power selection source circuit 230 of FIG. 8.

FIG. 10 shows an AC power detection circuit 250 coupling to an AC hot line as input. The circuit 250 provides an indication 252 that the AC power is "good" to the microcontroller discussed below in FIG. 12. FIG. 10 also shows the main AC input 254 and 5V power circuit 256 for the control circuitry.

Figure 11:
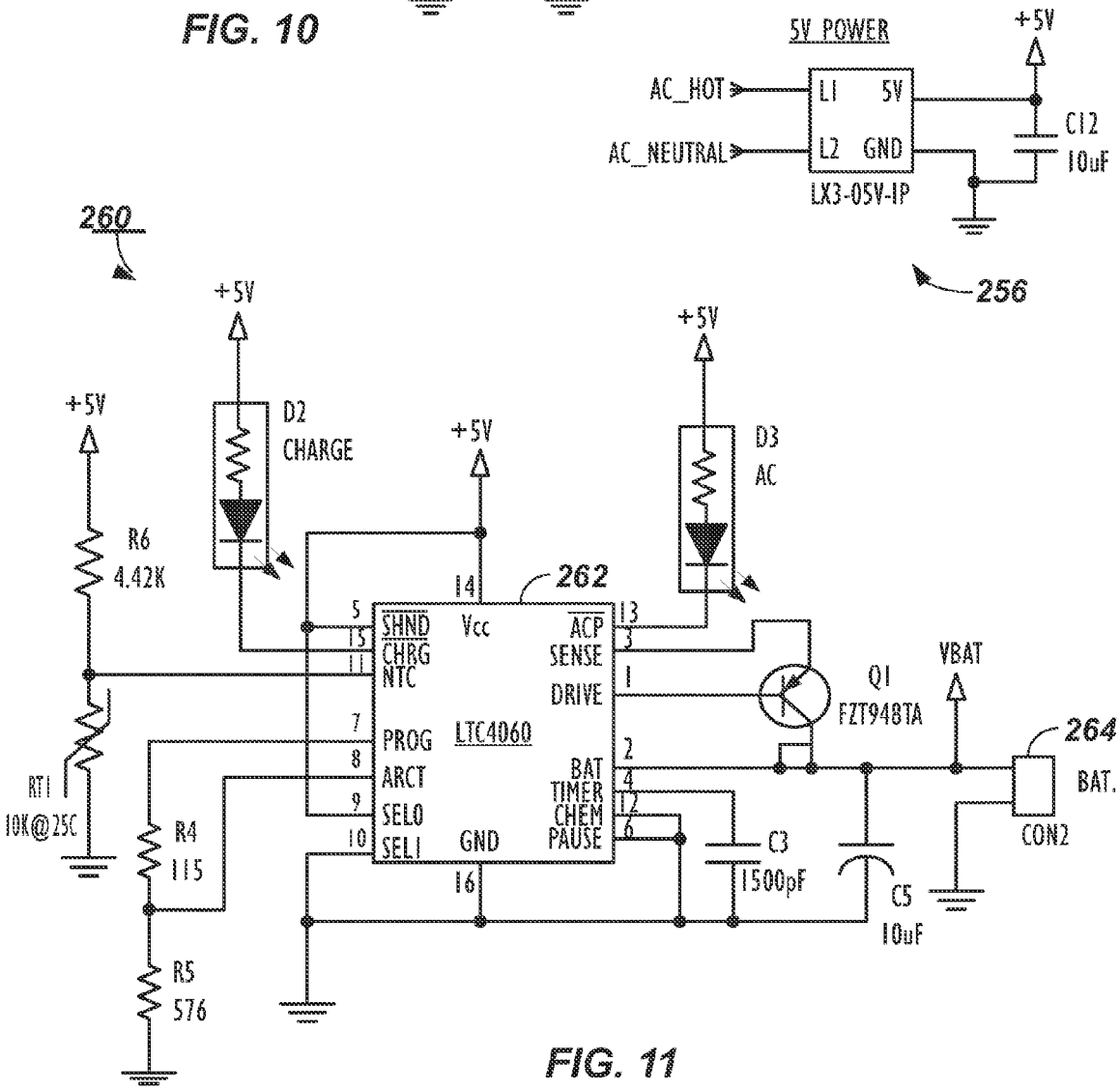

FIG. 11 shows a battery charger circuit 260 having a battery charger 262 that couples by a connection to a backup battery 264. The battery charger circuit 260 can use a linear NiMH/NiCd fast battery charger 262, such as the LTC4060 available from Linear Technology.

Figure 12:
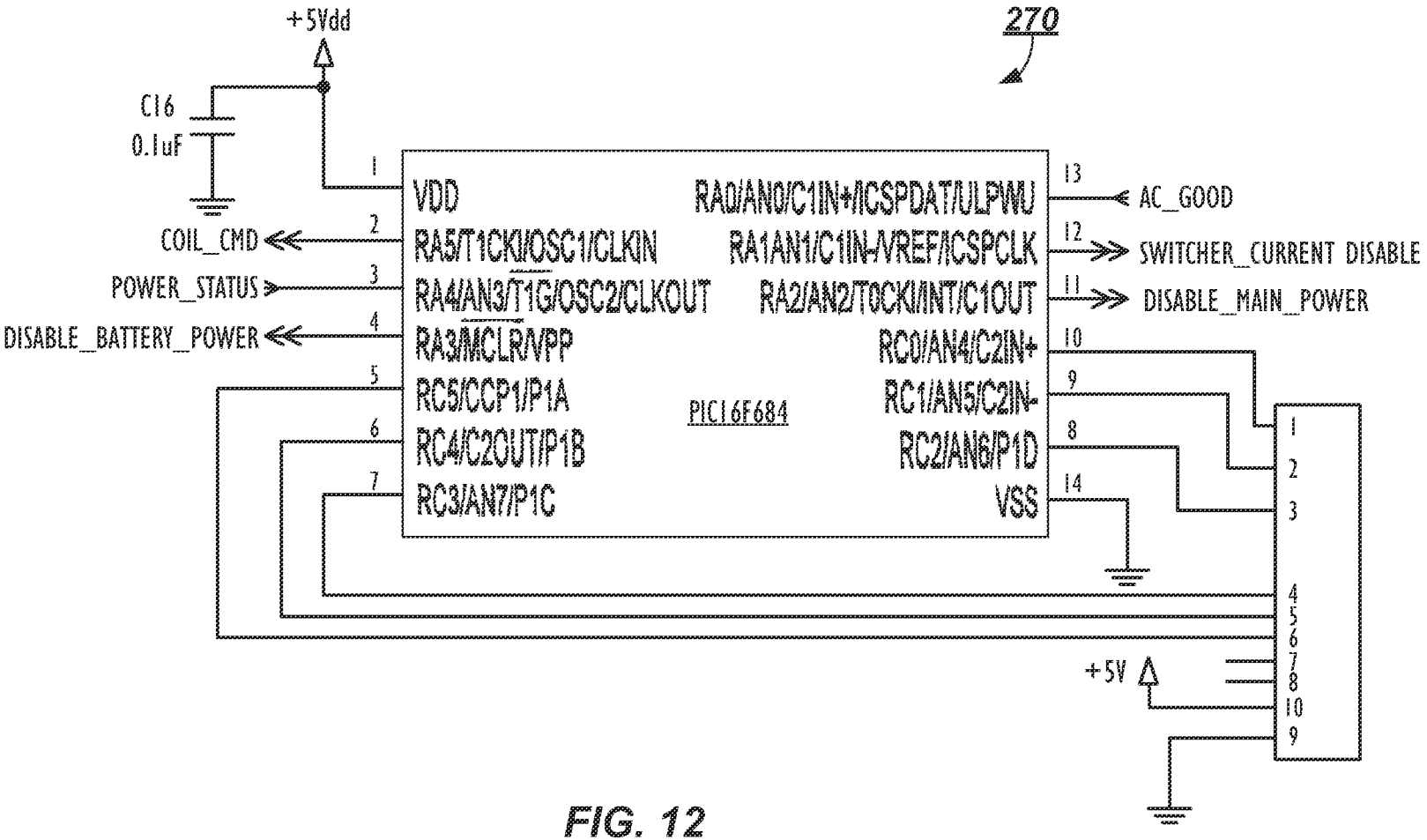

FIG. 12 shows a microcontroller 270 for the control circuitry. This microcontroller 270 can be a flash-based microcontroller with onboard EEPROM data memory. One suitable microcontroller 270 is the PIC16F684 available from Linear Technology. The microcontroller 270 couples to signal inputs and outputs for the control circuitry and is programmed in accordance with the functions described in the present disclosure.

As noted previously, the brightness of the EL panel (10) can be increased when the frequency is increased. To that end, the microcontroller 270 can be programmed to create the waveform for operating the EL panel (10) using pulse width modulation (PWM) signals. The microcontroller 270 reduces the time interval between each pulse. For a sine wave, the time that the PWM pulse is "ON" is the sine of the position of the PWM pulse divided by the period of the waveform. The time it is "OFF" is the difference of the period of the PWM pulse less the time it is "ON." The microcontroller 270 modifies the intervals of the pulses to control the brightness of the EL panel (10) with a preferred waveform and frequency as discussed previously.

Figure 13:
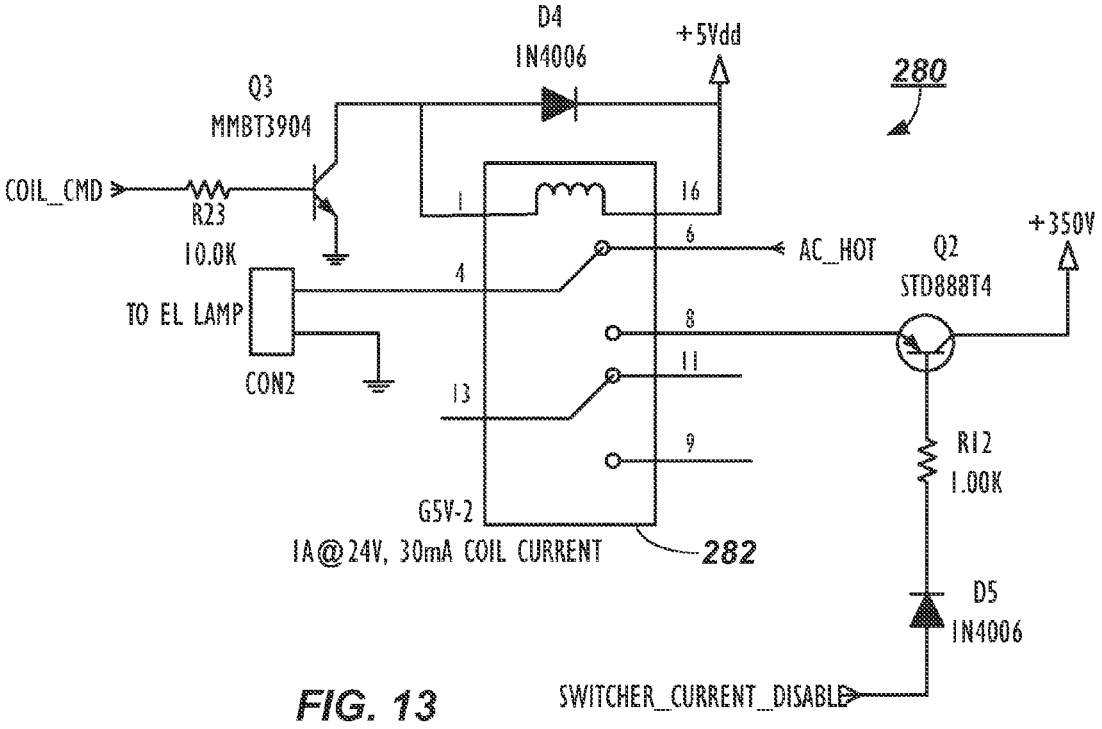

FIG. 13 shows a relay circuit 280 having a relay 282 for switching between AC power and switcher current. The relay 282 is controlled by a coil command from the microcontroller 270 of FIG. 12.

Figure 14:
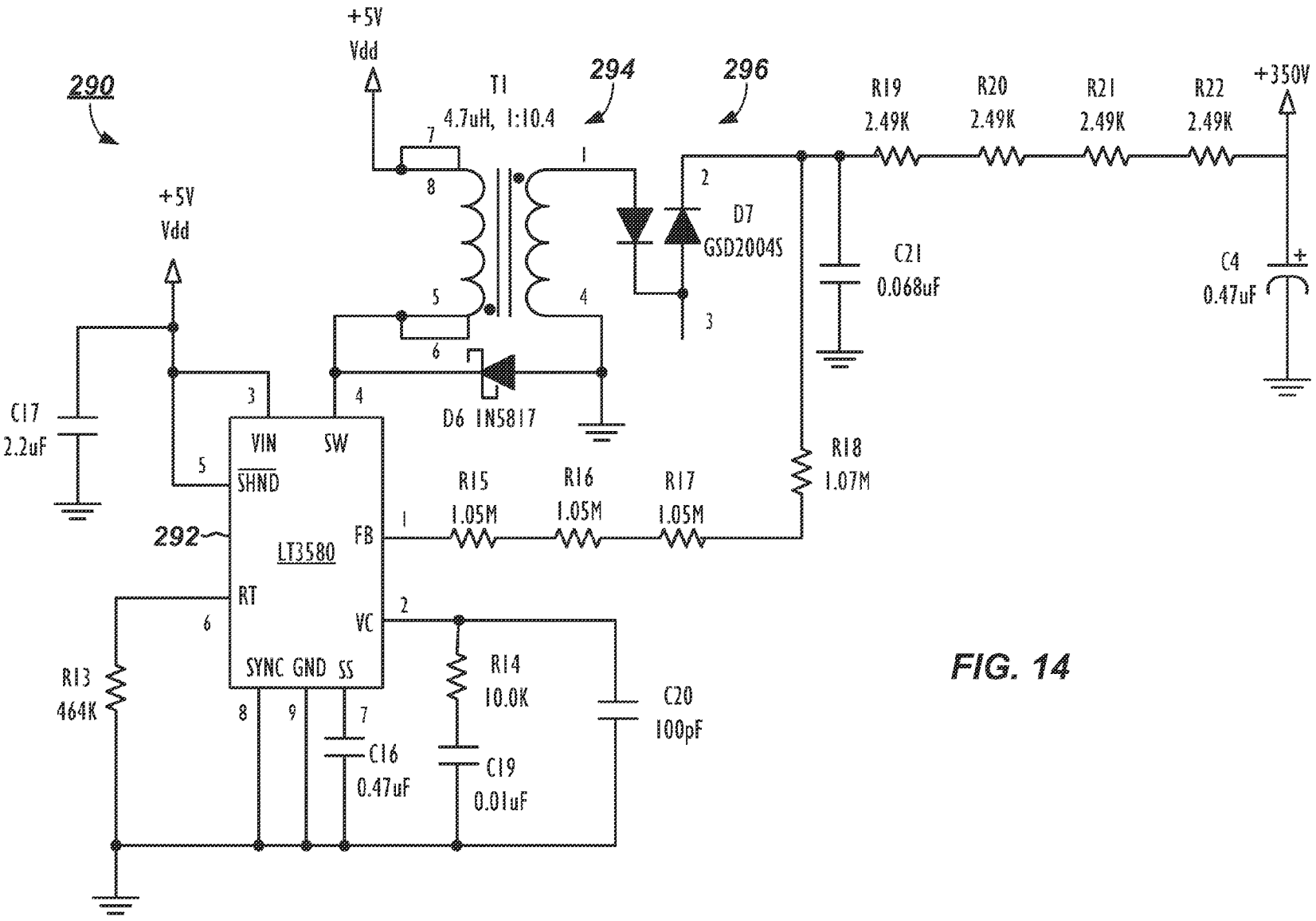

FIG. 14 shows power circuitry 290 having a PWM DC/DC converter 292, a transformer 294, and a switching diode 296 for the control circuitry. The PWM DC/DC converter 292 can use an LT3580 available from Linear Technology. The switching diode 296 can be a Dual In-Series Small-Signal High-Voltage Switching Diode series GSD2004S available from VISHAY Semiconductors.

Poles (7-8) of the transformer 294 connect to the Overvoltage Protection Sense Input (OVI) and Overvoltage Protection Output (OVP) pins on the O-ring diode (232) of FIG. 8. Poles (1-5) of the transformer 294 and switching diode 296 connect to pins for the second channel on the step-up DC/DC converter (242) of the backup power circuit (240) of FIG. 9. The pins include the second channel's battery input voltage (VIN2), the logic controlled shutdown input (SHDN2), the output voltage sense and drain of the internal synchronous rectifier (VOUT2), the feedback input to the $g_m$ Error Amplifier (FB2), and the switch pin (SW2).

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A lighting system, comprising:

a receptacle for a light source disposed on a light fixture and coupling to a first power source;

an electroluminescent panel disposed adjacent the light fixture and coupling to the first power source; and circuitry illuminating the electroluminescent panel with power from the first power source when the receptacle for the light source is disconnected from the first power source.

2. The system of claim 1, comprising a shade disposed on the light fixture adjacent the receptacle, wherein the electroluminescent panel is disposed on the shade.

3. The system of claim 2, wherein the electroluminescent panel is disposed on an inside surface or an outside surface of the shade.

4. The system of claim 1, wherein the electroluminescent panel is disposed on a ceiling tile.

5. The system of claim 1, comprising a reflective surface disposed on the light fixture adjacent the receptacle, wherein the electroluminescent panel is disposed on the reflective surface.

6. The system of claim 1, wherein the receptacle is adapted to receive the light source selected from the group consisting of a fluorescent light, an incandescent light, a compact fluorescent light, a light emitting diode, and a halogen light.

7. The system of claim 1, wherein the receptacle is adapted to receive a fluorescent light as the light source, and wherein the circuitry comprises first power circuitry having a ballast regulating alternating current power from the first power source.

8. The system of claim 1, wherein the circuitry comprises second power circuitry illuminating the electroluminescent panel with alternating current power adapted from the first power source.

9. The system of claim 1, wherein the circuitry comprises a controller having first and second states, the controller in the first state connecting the receptacle to the first power source and disconnecting the electroluminescent panel from the first power source, the controller in the second state disconnecting the receptacle from the first power source and connecting the electroluminescent panel to the first power source.

10. The system of claim 9, wherein the controller comprises a switch disposed on the light fixture.

11. A lighting system, comprising:

a receptacle for a light source disposed on a light fixture and coupling to a first power source;

an electroluminescent panel disposed adjacent the light fixture and coupling to a second power source; and circuitry illuminating the electroluminescent panel with power from the second power source during a failure of the first power source.

12. The system of claim 11, wherein the circuitry powers the electroluminescent panel with power from a direct current source as the second power source during the failure of the first power source.

13. The system of claim 12, wherein the first power source is an alternating current power source.

14. The system of claim 11, comprising a shade disposed on the light fixture adjacent the receptacle, wherein the electroluminescent panel is disposed on the shade.

15. The system of claim 14, wherein the electroluminescent panel is disposed on an inside surface or an outside surface of the shade.

16. The system of claim 11, wherein the electroluminescent panel is disposed on ceiling tile.

17. The system of claim 11, comprising a reflective surface disposed on the light fixture adjacent the receptacle, wherein the electroluminescent panel is disposed on the reflective surface.

18. The system of claim 11, wherein the receptacle is adapted to receive the light source selected from the group consisting of a fluorescent light, an incandescent light, a compact fluorescent light, a light emitting diode, and a halogen light.

19. The system of claim 11, wherein the receptacle is adapted to receive a fluorescent light as the light source, and wherein the circuitry comprises first power circuitry having a ballast regulating alternating current from the first power source.

20. The system of claim 11, wherein the circuitry comprises second power circuitry illuminating the electroluminescent panel with alternating current power adapted from the second power source.

21. The system of claim 11, wherein the circuitry comprises a controller having first and second states, the controller in the first state disconnecting the electroluminescent panel from the second power source, the controller in the second state connecting the electroluminescent panel to the second power source.

22. The system of claim 21, wherein the controller in the first state connects the electroluminescent panel to the first power source when the receptacle is disconnected from the first power source and disconnects the electroluminescent panel from the first power source when the receptacle is connected to the first power source.

23. The system of claim 22, wherein the controller decreases brilliance of the electroluminescent panel when the controller in the first state connects the electroluminescent panel to the first power source.

24. The system of claim 21, wherein the controller increases brilliance of the electroluminescent panel when the controller in the second state connects the electroluminescent panel to the second power source.

25. The system of claim 24, wherein to increase the brilliance of the electroluminescent panel, the controller adjusts a voltage, a rise time of a waveform, or a frequency of a waveform used to power the electroluminescent panel.

* * * * *